US011686064B2

(12) United States Patent
Babl et al.

(10) Patent No.: US 11,686,064 B2
(45) **Date of Patent: *Jun. 27, 2023**

(54) SKID-STEER LOADER IMPLEMENT

(71) Applicant: Babl Industries, LLC, Rapid City, SD (US)

(72) Inventors: Gary L. Babl, Rapid City, SD (US); Helen Pich, Rapid City, SD (US)

(73) Assignee: Babl Industries, LLC, Rapid City, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/738,051

(22) Filed: May 6, 2022

(65) Prior Publication Data

US 2022/0259814 A1 Aug. 18, 2022

Related U.S. Application Data

(63) Continuation of application No. 17/330,683, filed on May 26, 2021, now Pat. No. 11,346,074, which is a continuation of application No. 15/798,657, filed on Oct. 31, 2017, now Pat. No. 11,047,106.

(51) Int. Cl.

| | |
|---|---|
| ***E02F 3/36*** | (2006.01) |
| ***E02F 3/42*** | (2006.01) |
| ***E02F 3/358*** | (2006.01) |
| *E02F 3/34* | (2006.01) |

(52) U.S. Cl.

CPC ..... *E02F 3/3681* (2013.01); *E02F 3/358* (2013.01); *E02F 3/3677* (2013.01); *E02F 3/42* (2013.01); *E02F 3/3414* (2013.01)

(58) Field of Classification Search

CPC ..... E02F 3/3681; E02F 3/358; E02F 3/3677; E02F 3/7618

See application file for complete search history.

(56) References Cited

U.S. PATENT DOCUMENTS

| | | | | |
|---|---|---|---|---|
| 2,753,638 | A * | 7/1956 | Mork | E02F 3/7618 172/825 |
| 3,083,480 | A | 4/1963 | Kirchler | |
| 3,084,461 | A | 4/1963 | Beckford | |
| 3,653,131 | A | 4/1972 | Pilch | |
| 3,690,386 | A | 9/1972 | Magee | |
| 3,795,280 | A | 3/1974 | Casey | |

(Continued)

FOREIGN PATENT DOCUMENTS

| | | | |
|---|---|---|---|
| CN | 101255704 | A | 9/2008 |
| WO | 2019089620 | A1 | 5/2019 |

OTHER PUBLICATIONS

Foreign communication from a related counterpart application—International Preliminary Report on Patentability, PCT/US2018/058250 dated May 5, 2020, 10 pages.

(Continued)

*Primary Examiner* — Gerald McClain

(74) *Attorney, Agent, or Firm* — Barnes & Thornburg LLP; Jerry C. Harris, Jr.

(57) ABSTRACT

A skid-steer implement allows for the rotation of a tool attachment relative to the body of the skid-steer by coupling an attaching element and a rotation attachment device with a shaft and force generating devices. The slim construction of the device allows for bucket rotation while limiting the tipping load change caused by the extension of the implement.

16 Claims, 6 Drawing Sheets

(56) References Cited

U.S. PATENT DOCUMENTS

| | | | | |
|---|---|---|---|---|
| 4,281,721 | A | 8/1981 | Beales | |
| 4,512,090 | A | 4/1985 | Billings | |
| 4,824,319 | A | 4/1989 | Arnold | |
| 5,114,299 | A * | 5/1992 | Roche | E02F 3/404 414/722 |
| 5,403,144 | A | 4/1995 | Staben, Jr. | |
| 5,562,398 | A | 10/1996 | Knutson | |
| 5,732,781 | A | 3/1998 | Chambers | |
| 5,938,399 | A | 8/1999 | Knutson | |
| 6,360,459 | B1 | 3/2002 | Brookhart et al. | |
| 11,047,106 | B2 * | 6/2021 | Babi | E02F 3/42 |
| 2009/0096190 | A1 | 4/2009 | Sharp | |
| 2020/0087885 | A1 | 3/2020 | Smith | |

OTHER PUBLICATIONS

Foreign communication from a related counterpart application—International Search Report and Written Opinion, PCT/US2018/058250 dated Feb. 21, 2019, 12 pages.

* cited by examiner

SKID-STEER LOADER IMPLEMENT

CROSS-REFERENCE TO RELATED APPLICATIONS

This application is a continuation of U.S. patent application Ser. No. 17/330,683 filed on May 26, 2021 and entitled "SKID-STEER LOADER IMPLEMENT", which is a continuation of U.S. patent application Ser. No. 15/798,657 filed on Oct. 31, 2017 and entitled "SKID-STEER LOADER IMPLEMENT", which are incorporated by reference herein in their entirety.

BACKGROUND

Skid-steer loaders are incredibly versatile pieces of machinery. They are employed in a variety of environments and are capable of doing a wide variety of tasks. This versatility is due in part to the small size, short wheelbase, and low weight, and cheap operating cost of skid-steer loaders relative to other pieces of equipment. This small size and weight allow them great freedom of movement that larger pieces of heavy equipment may not enjoy. As such, a skid-steer loader (a/k/a "skid-steer") is often tasked to take on a variety of jobs from digging trenches, to loading cargo, to grading. Many skid-steers are equipped with a hydraulic system to allow them to link to and control tools which may be attached to the front of the loader where the bucket traditionally sits. This has allowed the skid-steer operator to greatly increase the range of tasks that the skid-steer is able to perform. One such attachment allows the skid-steer operator to control the lateral rotation of an attachment. This is extremely helpful when engaging in tasks like grading or cutting swales where the desired grade being operated on with the cutting edge of the skid-steer's bucket may not be parallel to the skid-steer's body. The same attribute that contributes to the skid-steer's versatility, its small size, also creates hard upper limits on its ability to safely lift a load. A skid-steer's low mass and its distribution of that mass is such that it also has a relatively low "tipping load." While a skid-steer is unloaded, approximately 70% of its weight may be over the rear axle, with only approximately 30% over the front axle. When a skid-steer bucket is loaded, this ratio may reverse, with most of the weight being over the front axle, and the front axle becomes a fulcrum point for possible tipping. As such, any increase in the distance between the carried load and the front axle causes a disproportionately large decrease in the amount of load that may be safely carried. Currently, implements used to enable rotation of a tool attached to the front of a skid-steer are both heavy and create and greatly increase the distance between the front axle and the carried load, greatly decreasing the amount of weight that may be safely carried by the bucket or tool itself.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
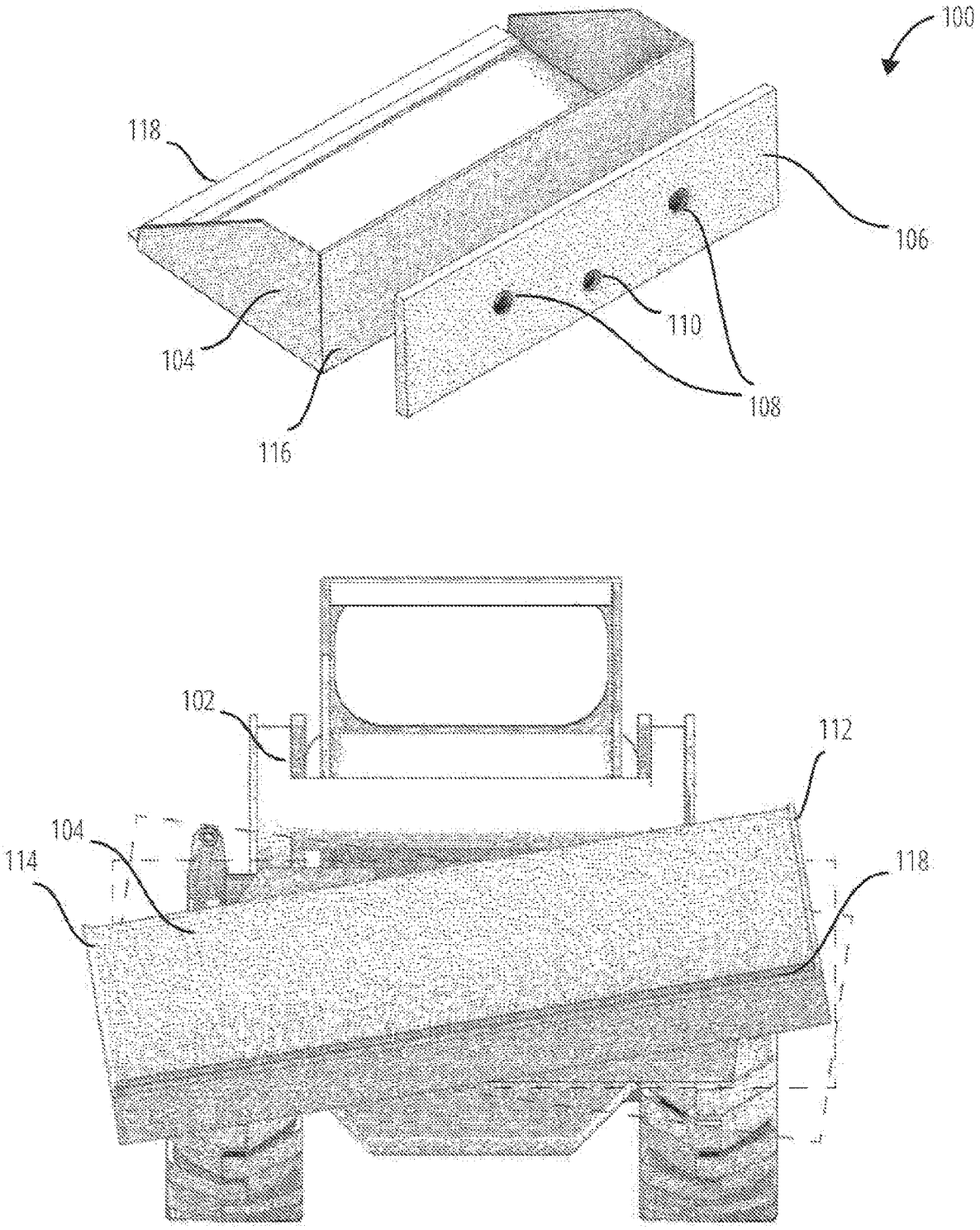
FIG. 1 illustrates an environment for a skid-steer implement 100.

Embodiments of an attachment are disclosed herein to enable a skid-steer operator to rotate the cutting edge of a bucket approximately 10 degrees up or down on either end of the bucket (e.g., between 8 and 13 degrees). The attachment reduces the tipping load change due at least in part to a more compact design.

The skid-steer implement 100 comprises a mobile mechanical device 102, a bucket 104, a rotation attachment device 106, a holes 108, a hole 110, an outside edge 112, an outside edge 114, a rearmost portion of the bucket 116, and a cutting edge 118.

The rotation attachment device 106 may be a steel plate (e.g., ⅜ inch thickness) with three holes, hole 110 and holes 108 formed, for example, by drilling. The two outside holes 108 enable the plate to be welded to the back of the bucket 116. The rotation attachment device 106 may also act as a back portion of the bucket 104 thus simplifying the construction of the skid-steer implement 100.

The bucket 104 may have a width, for example, of 84 inches. The rearmost portion of the bucket 116 which may attach to the rotation attachment device 106, may be 5/16 inches thick, for example. The skid-steer implement 100 may enable the bucket 104 to perform all the normal tasks of a conventional bucket attachment, and further enable the bucket 104 to rotate the bucket 104 relative to the mobile mechanical device 102 such that the outside edge 114 may be raised or lowered relative to the outside edge 112 and the outside edge 112 may be raised or lowered relative to the outside edge 114. This enables the operator to initiate a change of grading elevation without having to change the elevation of the skid-steer. The skid-steer implement 100 brings the cutting edge 118 closer to the skid-steer mounting plates thus reducing the effects on the tipping load.

A device may include an attaching element, the attaching element configured to attach to a mobile mechanical device, couple to one or more force generating devices and rotatably engage a shaft. The one or more force generating devices configured to couple to the attaching element, couple to a rotation attachment device, receive a force activation input and apply a force to the attaching element and the rotation attachment device. The rotation attachment device, the rotation attachment device configured to attach to the shaft, attach to a bucket and rotate in response to receiving the force from one of the one or more force generating devices. The shaft may be configured to rotate within the attaching element in response to the force, and the bucket rotating in response to receiving the force from the shaft configured to rotate within the attaching element in response to the force.

Such a device may further include a first shaft end cap, the first shaft end cap coupled to the shaft and the bucket. The attaching element may further include one or more bushings to enable the attaching element to rotatably engage the shaft. The shaft may further include a second shaft end cap, the second shaft end cap securing the one or more bushings. The attaching element may further include one or more spaced mounting elements, the one or more spaced mounting elements attached to the mobile mechanical device and configured to ensure the shaft and the second shaft end cap do not extend past the one or more spaced mounting elements. The one or more force generating devices may be configured to operate with a variety of actuators to generate force. For example, mechanical actuator may be used to impart force in the one or more force generating devices. The force may be generated utilizing pneumatic or hydraulic actuators (a linear hydraulic motor) to impart a unidirectional force through a unidirectional stroke. The mechanical actuator may use energy stored internally through springs, or may further take the form of a rotary actuator which may positioned to impart a rotary motion or torque directly to the attaching element and the rotation attachment device. The mechanical actuator may also be a belt, chain, or gear-driven linear actuator. For example, a rack and pinion, worm and worm gear, chain and sprocket, belt and pulley or other mechanical system may be used. The belt or gear-driven linear actuator may impart force to the attaching element and the rotation attachment device through the application of linear motion in one direction to give rise to rotation. The mechanical actuators may be powered utilizing electric motors and gears to translate electrical power into mechanical power to generate force. The mechanical actuators may also utilize electromagnetism directly to generate the force imparted to the attaching element and the rotation attachment device by the force generating devices.

Where the force activation input is pneumatically or hydraulically-based, a fluid or gas medium may be directed to one of the one or more force generating devices. Such a device may further include a valve, the valve directing the medium to the one or more force generating devices. The valve is operated by a valve control system, the valve receiving operating signals from the valve control system and operating in response. The valve is attached to the rotation attachment device. Such a device may further include a valve cover, the valve cover attached to the rotation attachment device. The valve receives the medium from the mobile mechanical device. The one or more force generating devices may further include one or more hoses and the attaching element. The one or more force generating devices may further include one or more coupling straps, the one or more coupling straps securing the one or more hoses. Where an electrical or magnetic actuator is used, power and data cables may be routed substantially similarly to hydraulic lines. In place of a valve control system, a controller may be implemented to control the distribution of force generated by the force generating devices. The controller may be operated to send signals to one or more motors in the force generating devices to control the activation of motors to impart force, or to control electromagnets to directly impart force. The rotation attachment device may further include one or more rotation guides, the one or more rotation guides configured to attach to the rotation attachment device and to partially enclose the attaching element. The one or more rotation guides may include one or more wear plates, the one or more wear plates attached to the one or more rotation guides and oriented to be located between the one or more rotation guides and the attaching element. The rotation attachment device 106 is cast with the bucket 104. A first width of the bucket is greater than a second width of the rotation attachment device. The rotation attachment device may include holes, the holes utilized to attach the rotation attachment device to the bucket.

Figure 6:
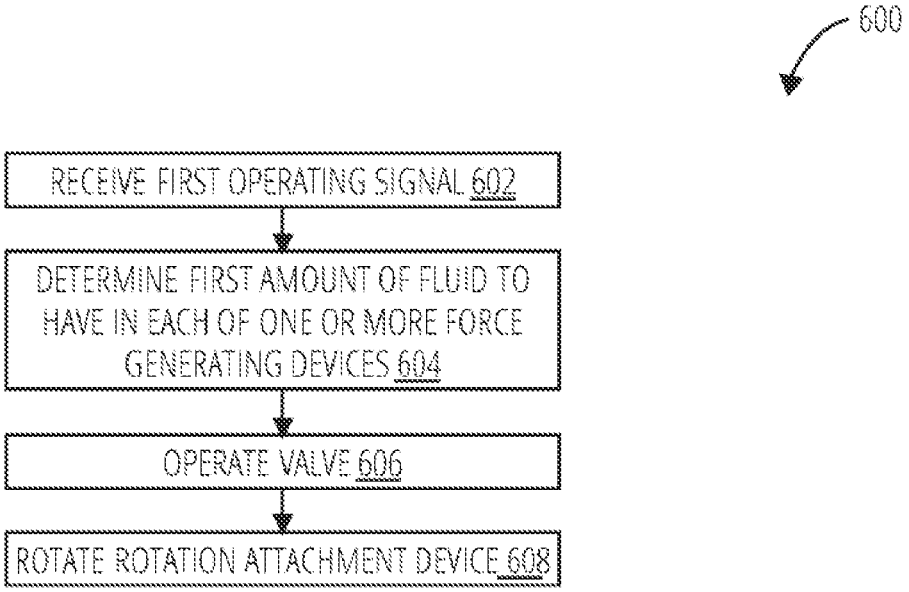
FIG. 6 illustrates an embodiment of a pneumatic operating method 600.

The skid-steer implement 100 may be operated in accordance with the process outlined in FIG. 6.

Figure 2:
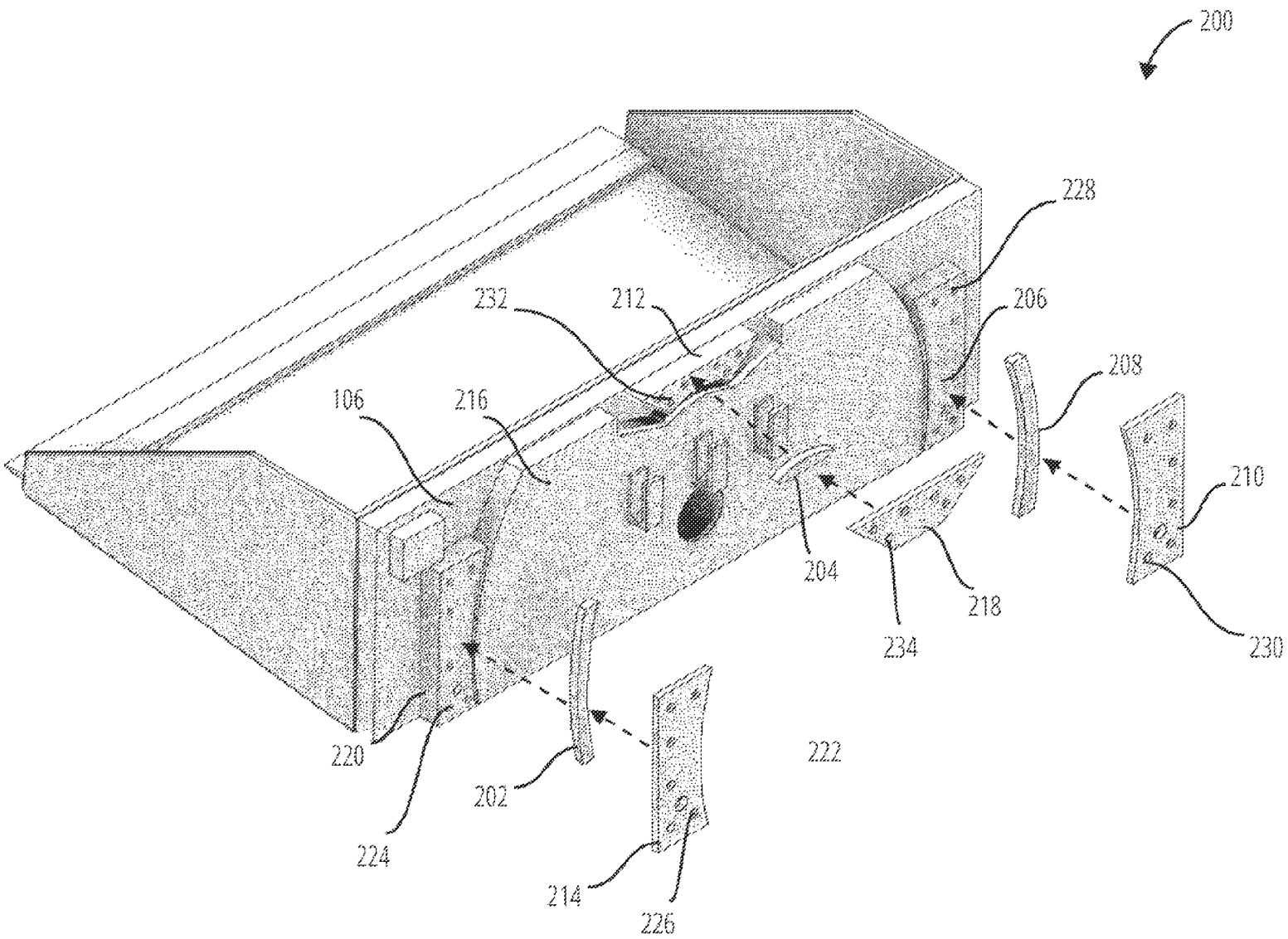
FIG. 2 illustrates an embodiment of a skid-steer implement 200.

Referencing FIG. 2, the skid-steer implement 200 comprises a rotation attachment device 106, a one or more wear plates 202, a one or more wear plates 204, a one or more rotation guides 206, a one or more wear plates 208, a one or more rotation guides 210, a one or more rotation guides 212, a one or more rotation guides 214, an attaching element 216, a one or more rotation guides 218, a one or more rotation guides 220, a holes 224, a holes 226, a holes 228, a holes 230, a holes 232, and a holes 234.

The one or more rotation guides 206 may be constructed of ¾ inch steel, for example, and may be welded to the rotation attachment device 106, or attached by other suitable means known in the art. The one or more rotation guides 206 are mounted toward the right side of the rotation attachment device 106. The one or more rotation guides 206 may have six holes 228, which may be tapped to accept 14 inch bolts, for example, and the one or more rotation guides 210 may have six holes 230 and may be bolted or otherwise suitable attached to the one or more rotation guides 206 with, for example, in an embodiment, by six ½ inch bolts. In an embodiment, the one or more rotation guides 210 may be constructed from ⅜ inch steel, for example, and may have, for example, a ⅜ inch Ultra-High Molecular Weight plastic (UHMW) wear plate bolted or otherwise suitably attached to it on a side that is closest to the front of the bucket 104.

In an embodiment, the one or more rotation guides 220 may be constructed of ¾ inch steel, for example, may be welded to the rotation attachment device 106, or attached by other suitable means known in the art. The one or more rotation guides 220 are mounted toward the left side of the rotation attachment device 106. In an embodiment, the one or more rotation guides 220 may have six holes 224, which may be tapped to accept ½ inch bolts, for example, and the one or more rotation guides 214 may have six holes 226 and may be bolted or otherwise suitable attached to the one or more rotation guides 220 with, for example, by six ½ inch bolts. In an embodiment, the one or more rotation guides 214 may be constructed from ⅜ inch steel, for example, and may have, for example, a ⅜ inch UHMW wear plate bolted or otherwise suitably attached to it on a side that is closest to the front of the bucket 104.

In an embodiment, the one or more rotation guides 212 may be constructed of ¾ inch steel, for example, and may be welded to the rotation attachment device 106 or attached by other suitable means known in the art. The one or more rotation guides 212 may be mounted at the top and in the middle of the rotation attachment device 106. In an embodiment, the one or more rotation guides 212 may have six holes 232, which may be tapped to accept ½ inch bolts, for example, and the one or more rotation guides 218 may have six holes 234 and be bolted or otherwise suitable attached to the one or more rotation guides 212 with, for example, by six ½ inch bolts. In an embodiment, the one or more rotation guides 218 may be constructed from ⅜ inch steel, for example, and may have, for example, a ⅜ inch UHMW wear plate bolted or otherwise suitably attached to it on a side that is closest to the front of the bucket 104.

The outside edges and the top middle part of the attaching element 216 are designed to rotate under the one or more rotation guides 214, the one or more rotation guides 218 and the one or more rotation guides 210.

The skid-steer implement 200 may be operated in accordance with the process outlined in FIG. 6.

Figure 3:
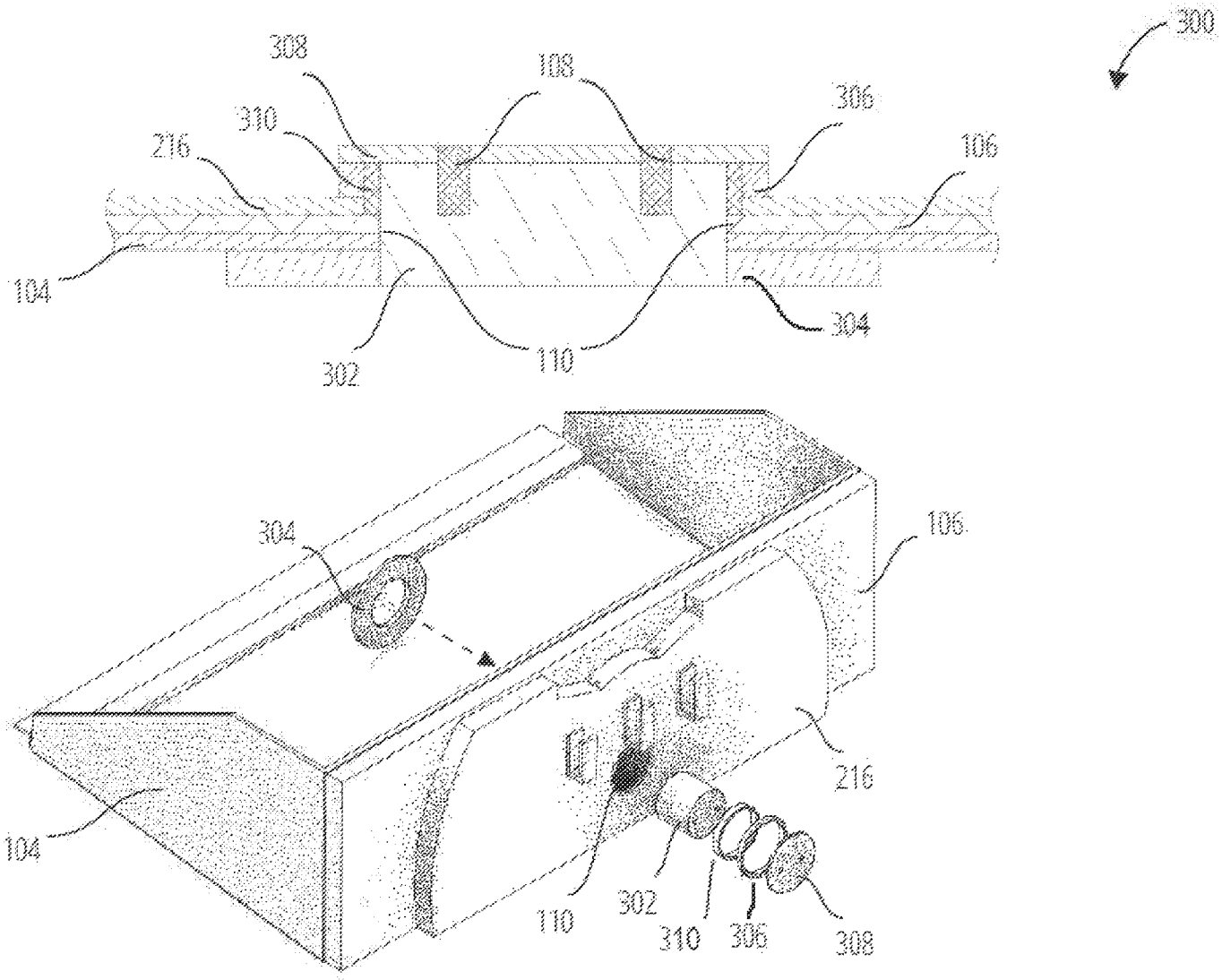
FIG. 3 illustrates an embodiment of a skid-steer implement 300.

Referencing FIG. 3, the skid-steer implement 300 comprises a bucket 104, a rotation attachment device 106, a holes 108, a hole 110, an attaching element 216, a shaft 302, a first shaft end cap 304, a one or more bushings 306, a second shaft end cap 308, and a one or more bushings 310.

The hole 110 may be positioned in the attaching element 216 and the rotation attachment device 106 to enable the shaft 302 to form an axis about which the bucket 104 and rotation attachment device 106 may rotate independent of the attaching element 216.

The bucket 104 may be positioned between the rotation attachment device 106 and the first shaft end cap 304. The one or more bushings 306 may be positioned between the second shaft end cap 308 and the attaching element 216. The one or more bushings 310 may be positioned between the rotation attachment device 106 and the second shaft end cap 308. The shaft 302 may be positioned inside the central hole 110, and against the second shaft end cap 308 and the first shaft end cap 304.

The gap between the one or more spaced mounting elements 402 and the attaching element 216, created by the steel spacers 408 welded to the back side of the one or more spaced mounting elements 402, may provide room such that the one or more bushings 306 and end cap 308 do not protrude past the one or more spaced mounting elements 402.

The one or more bushings 306 may be welded or otherwise suitably attached to the attaching element 216. An innermost one or more bushings 306 may be made from brass, for example, and may be located between an outermost one or more bushings 306 and the shaft 302. The innermost one or more bushings 310 may be held in place by the second shaft end cap 308 which may be bolted or otherwise suitably attached to the end of the steel shaft. The first shaft end cap 304 may be welded or otherwise suitably attached on an inside surface of the bucket 104, the shaft 302 may welded to the first shaft end cap 304.

The skid-steer implement 300 may be operated in accordance with the process outlined in FIG. 6.

Figure 4:
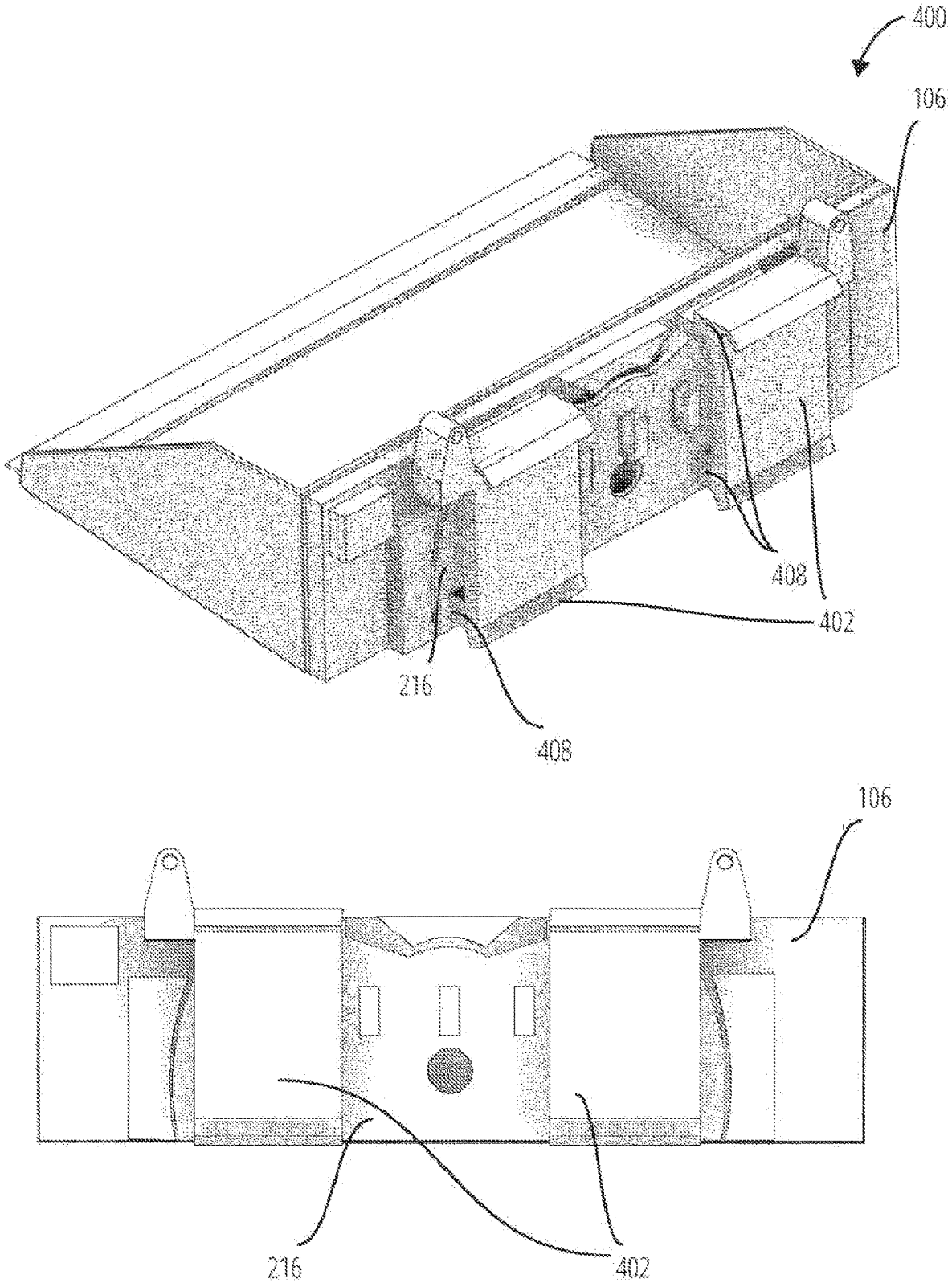
FIG. 4 illustrates an embodiment of a skid-steer implement 400.

Referencing FIG. 4, the skid-steer implement 400 comprises a rotation attachment device 106, a one or more spaced mounting elements 402, an attaching element 216, and a steel spacers 408.

In an embodiment, the attaching element 216 may be constructed from ⅜ inch plate steel, for example, with the one or more spaced mounting elements 402 welded to it. In an embodiment, the one or more spaced mounting elements 402 may have two one-inch thick (for example) steel spacers 408 welded to the backside of each, to create a one-inch gap (for example) between the one or more spaced mounting elements 402 and the attaching element 216.

The skid-steer implement 400 may be operated in accordance with the process outlined in FIG. 6.

Figure 5:
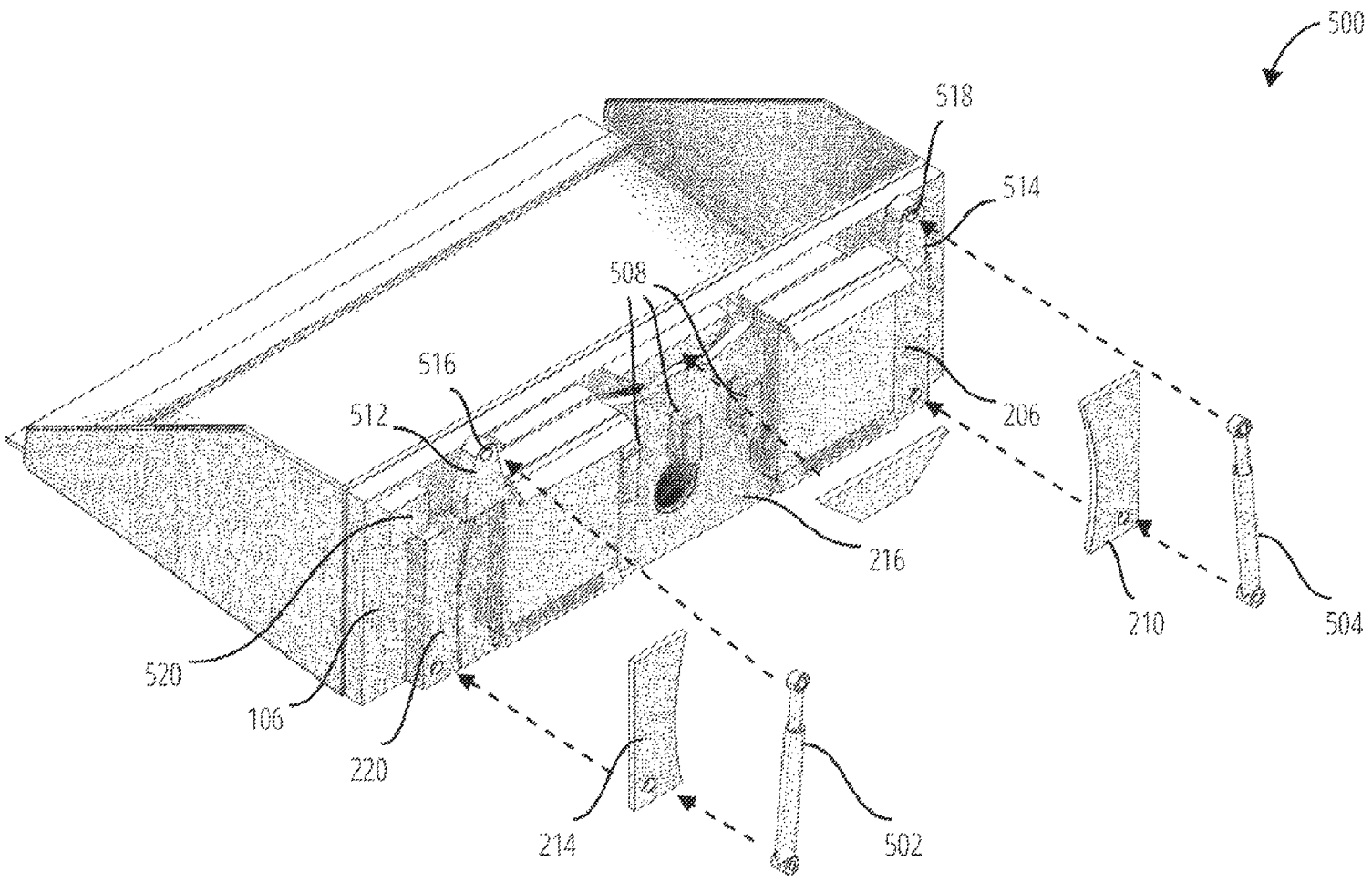
FIG. 5 illustrates an embodiment of a skid-steer implement 500.

Referring to FIG. 5, the skid-steer implement 500 comprises a rotation attachment device 106, an attaching element 216, a one or more rotation guides 220, a one or more rotation guides 206, a one or more force generating devices 502, a one or more force generating devices 504, a one or more rotation guides 214, a hydraulic hose hangers 508, a one or more rotation guides 210, a mounting bracket 512, a mounting bracket 514, a hole 516, a hole 518, and a valve 520.

The one or more force generating devices 502 may be mounted to the attaching element 216 by way of the mounting bracket 512. In an embodiment, the mounting bracket 512 may have a hole 516 with, for example, a ¾ inch bore to enable a bolt or rod to slide through mounting bracket 512.

The one or more force generating devices 502 may be mounted to the rotation attachment device 106 by way of the one or more rotation guides 214 and the one or more rotation guides 220. In an embodiment, a ¾ inch bolt is welded to rotation guide 214 to attach device 502.

The one or more force generating devices 504 may be mounted to the attaching element 216 by way of the mounting bracket 514. In an embodiment, the mounting bracket 514 may have a hole 518 with, for example, a ¾ inch bore to enable a bolt or rod to slide through mounting bracket 514.

The one or more force generating devices 504 may be mounted to the rotation attachment device 106 by way of the one or more rotation guides 210 and the one or more rotation guides 206. In an embodiment, a ¾ inch bolt is welded to rotation guide 210 to attach device 504.

Hydraulic hoses may be routed from the valve 520 to the one or more force generating devices 502 and the one or more force generating devices 504. The attaching element 216 may have, for example, three hydraulic hose hangers 508 that are welded or otherwise suitably attached to it.

The skid-steer implement 500 may be operated in accordance with the process outlined in FIG. 6.

Referencing FIG. 6 the hydraulic operating method 600 receives a first operating signal, comprising instructions to rotate a rotation attachment device in a first angular direction by a first angular distance (block 602).

Determine a first amount of fluid to have in each of one or more force generating devices to rotate the rotation attachment device in the first angular direction by a first angular distance (block 604).

Operate a valve to send the first amount of the fluid to each of the one or more force generating devices to generate a hydraulic differential (block 606).

Rotate the rotation attachment device in the first angular direction by the first angular distance in response to the hydraulic differential (block 608).

A method may include receiving a first operating signal, determining a first amount of fluid to have in each of one or more force generating devices to rotate the rotation attachment device in the first angular direction by a first angular distance, operating a valve to send the first amount of the fluid to each of the one or more force generating devices to generate a hydraulic differential, and/or rotating the rotation attachment device in the first angular direction by the first angular distance in response to the hydraulic differential. The first operating signal may include instructions to rotate a rotation attachment device in a first angular direction by a first angular distance. Such a method may further include in response to rotating the rotation attachment device in the first angular direction by the first angular distance, operating the valve to send a second amount of the fluid to each of the one or more force generating devices to generate a hydraulic equilibrium. Such a method may further include varying the first amount of the fluid and a second amount of the fluid sent to the one or more force generating devices based on a current angular distance in the first angular direction.

What is claimed is:

1. A device comprising:

an attaching element, the attaching element configured to:
- attach to a mobile mechanical device;
- couple to one or more force generating devices; and
- rotatably engage a shaft;

the one or more force generating devices, the one or more force generating devices configured to:
- couple to the attaching element;
- couple to a rotation attachment device;
- receive a force activation input; and
- apply a force to the attaching element and the rotation attachment device;

the rotation attachment device, wherein the rotation attachment device further comprises one or more rotation guides, and wherein the one or more force generating devices are disposed on the one or more rotation guides, the rotation attachment device configured to:

attach to the shaft;

attach to a bucket; and rotate in response to receiving the force from one of the one or more force generating devices;

the one or more rotation guides, wherein the one or more rotation guides comprise one or more wear plates, the one or more rotation guides configured to:

attach to the rotation attachment device; and partially enclose the attaching element;

the one or more wear plates, the one or more wear plates configured to:

attach to the one or more rotation guides; and orient to be located between the one or more rotation guides and the attaching element;

the shaft, the shaft configured to rotate within the attaching element in response to the force; and the bucket configured to receive a force from the one or more force generating devices by way of the rotation attachment device such that the rotational motion is imparted to the bucket allowing it to rotate axially about the shaft;

wherein the one or more rotation guides comprise a top rotation guide, a right rotation guide, and a left rotation guide, wherein the shaft is disposed in a hole through the bucket and the attachment element, located between the right rotation guide and the left rotation guide and under the top rotation guide, wherein at least one hydraulic hose hanger is disposed between the hole and the top rotation guide.

2. The device of claim 1 further comprising a first shaft end cap, the first shaft end cap coupled to the shaft and the bucket.

3. The device of claim 1, wherein the attaching element further comprises one or more bushings to enable the attaching element to rotatably engage the shaft, the shaft further comprising a second shaft end cap, the second shaft end cap securing the one or more bushings.

4. The device of claim 3, wherein the attaching element further comprises one or more spaced mounting elements, the one or more spaced mounting elements attached to the mobile mechanical device and configured to ensure the shaft and the second shaft end cap do not extend past the one or more spaced mounting elements.

5. The device of claim 1, the one or more force generating devices are configured to operate hydraulically, the force activation input being a fluid directed to one of the one or more force generating devices.

6. The device of claim 5, further comprising a valve, the valve directing the fluid to the one or more force generating devices.

7. The device of claim 6, wherein the valve is operated by a valve control system, the valve receiving operating signals from the valve control system and operating in response.

8. The device of claim 6, wherein the valve is attached to the rotation attachment device.

9. The device of claim 8, further comprising a valve cover, the valve cover attached to the rotation attachment device.

10. The device of claim 6, wherein the valve receives the fluid from the mobile mechanical device.

11. The device of claim 5, wherein the one or more force generating devices further comprise one or more hoses and the attaching element further comprise one or more coupling straps, the one or more coupling straps securing the one or more hoses.

12. The device of claim 1, wherein the rotation attachment device is cast with the bucket.

13. The device of claim 1, wherein a first width of the bucket is greater than a second width of the rotation attachment device.

14. A method comprising:

receiving a first operating signal, the first operating signal comprising instructions to rotate a rotation attachment device in a first angular direction by a first angular distance, wherein the rotation attachment device is configured to attach to a shaft, attach to a bucket, and rotate in response to receiving a force from one or more force generating devices;

determining a first amount of fluid to have in each of one or more force generating devices to rotate the rotation attachment device in the first angular direction by a first angular distance, the one or more force generating devices configured to couple to the rotation attachment device, couple to an attaching element, receive a force activation input, apply the force to the attaching element; wherein the rotation attachment device is configured to attach to a shaft, attach to the bucket, and rotate in response to receiving the force from the one or more force generating devices, wherein the rotation attachment device further comprises one or more rotation guides, wherein the one or more force generating devices are disposed on the one or more rotation guides, wherein the attaching element is configured to attach to a mobile mechanical device, couple to the one or more force generating devices, and rotatably engage the shaft, wherein the one or more rotation guides comprise one or more wear plates and the one or more rotation guides configured to attach to the rotation attachment device and partially enclose the attaching element, wherein the one or more wear plates are configured to attach to the one or more rotation guides and orient to be located between the one or more rotation guides and the attaching element, wherein the shaft is configured to rotate within the attaching element in response to the force, and wherein the bucket is configured to rotate axially about the shaft, wherein the one or more rotation guides comprise a top rotation guide, a right rotation guide, and a left rotation guide, wherein the shaft is disposed in a hole through the bucket and the attachment element, located between the right rotation guide and the left rotation guide and under the top rotation guide, wherein at least one hydraulic hose hanger is disposed between the hole and the top rotation guide operating a valve to send the first amount of the fluid to each of the one or more force generating devices to generate a fluid differential; and rotating the rotation attachment device in the first angular direction by the first angular distance in response to the fluid differential.

15. The method of claim 14, further comprising, in response to rotating the rotation attachment device in the first angular direction by the first angular distance, operating the valve to send a second amount of the fluid to each of the one or more force generating devices to generate a fluid equilibrium.

16. The method of claim 14, further comprising varying the first amount of the fluid and a second amount of the fluid sent to the one or more force generating devices based on a current angular distance in the first angular direction.

* * * * *